US009840057B2

(12) United States Patent
Carron et al.

(10) Patent No.: US 9,840,057 B2
(45) Date of Patent: Dec. 12, 2017

(54) METHOD FOR ADJUSTING THE RADIAL SPACING BETWEEN TWO TOOLS, EMBOSSING DEVICE AND FOLDER-GLUER PROVIDED THEREWITH

(71) Applicant: BOBST MEX SA, Mex (CH)

(72) Inventors: Christophe Carron, Carrouge (CH); Christophe Steiner, Crissier (CH); Roberto Valterio, Olllon (CH); Dieudonné Ngoy-Muvumbu, Renens (CH)

(73) Assignee: BOBST MEX SA (CH)

( * ) Notice: Subject to any disclaimer, the term of this patent is extended or adjusted under 35 U.S.C. 154(b) by 266 days.

(21) Appl. No.: 14/398,348

(22) PCT Filed: Apr. 17, 2013

(86) PCT No.: PCT/EP2013/001130
§ 371 (c)(1),
(2) Date: Oct. 31, 2014

(87) PCT Pub. No.: WO2013/164066
PCT Pub. Date: Nov. 7, 2013

(65) Prior Publication Data

US 2015/0126350 A1 May 7, 2015

(30) Foreign Application Priority Data

May 2, 2012 (EP) ..... 12003134

(51) Int. Cl.
*B31F 1/07* (2006.01)
*B31B 50/62* (2017.01)
(Continued)

(52) U.S. Cl.
CPC ..... *B31F 1/07* (2013.01); *B31B 50/62* (2017.08); *B41J 3/32* (2013.01); *B31B 50/88* (2017.08);
(Continued)

(58) Field of Classification Search
CPC ..... B31F 1/07; B31F 2201/0753; B31B 1/62; B31B 1/64; B31B 2201/88; B41J 3/32
(Continued)

(56) References Cited

U.S. PATENT DOCUMENTS

2012/0053031 A1* 3/2012 Diehr ..... B41J 3/32 493/16
2012/0053034 A1 3/2012 Diehr et al.

FOREIGN PATENT DOCUMENTS

EP 1 932 657 6/2008
WO WO 2008/043497 A1 4/2008

OTHER PUBLICATIONS

International Search Report dated Jul. 1, 2013 issued in corresponding International patent application No. PCT/EP2013/001130.

* cited by examiner

*Primary Examiner* — Michelle Lopez
(74) *Attorney, Agent, or Firm* — Ostrolenk Faber LLP

(57) ABSTRACT

A radial spacing, between two rotating cylindrical embossing tools, is adjustable, in an embossing device (14) having: an armature (19, 21); a first structure (16, 24, 26, 27, 29) which is movably mounted in translation relative to the armature (19, 21), which has a first rotating cylindrical tool (16); a second structure (17, 22, 28, 31) mounted in a fixed manner on the armature (19, 21) and which is provided with a second rotating cylindrical tool (17). A method includes steps of: pushing (T) on the first structure to move it closer to the second structure by leaning on the armature (19, 21) to adjust a radial space, or pulling (P) on the first structure
(Continued)

(16, 24, 26, 27, 29) in order to move it away from the second structure (17, 22, 28, 31) by leaning on the armature (19, 21) in order to finely adjust the radial spacing between the first and the second tools (16, 17).

12 Claims, 2 Drawing Sheets

(51) Int. Cl.
*B41J 3/32* (2006.01)
*B31B 50/88* (2017.01)

(52) U.S. Cl.
CPC . *B31F 2201/0753* (2013.01); *Y10T 29/49716* (2015.01)

(58) Field of Classification Search
USPC ..... 493/321
See application file for complete search history.

METHOD FOR ADJUSTING THE RADIAL SPACING BETWEEN TWO TOOLS, EMBOSSING DEVICE AND FOLDER-GLUER PROVIDED THEREWITH

CROSS-REFERENCE TO RELATED APPLICATIONS

The present application is a 35 U.S.C. §§371 National Phase conversion of PCT/EP2013/001130, filed Apr. 17, 2013, which claims priority of European Patent Application No. 12003134.9, filed May 2, 2012, the contents of which are incorporated by reference herein. The PCT International Application was published in the French language.

The present invention relates to a method for adjusting the radial spacing which exists between two rotating cylindrical tools which belong to an embossing device. The invention also relates to an embossing device which has two rotating cylindrical tools whose radial spacing can be adjusted. The invention relates to a folder-gluer which is provided with an embossing device which has two rotating cylindrical tools.

TECHNICAL BACKGROUND

In the packaging industry, the production of boxes is carried out in line, by folding and gluing cardboard blanks using machines which are called folder-gluers. A folder-gluer comprises a series of modules and stations, each comprising functional arrangements. The number of modules varies in accordance with the complexity of the production operations which the type of box selected requires. The folder-gluer is provided with a feeder which supplies the machine blank by blank from a stack, an alignment module, a breaker which pre-breaks the non-longitudinal folds, folders with hooks which fold the front lugs and then the rear lugs of the blank, a gluing station, a folder for folding the longitudinal folds of the blank, a presser which compresses all of the folds and deposits the boxes in a shingle stream, and a delivery module which receives the boxes while maintaining them in a pressed state in order to allow the glue to dry.

The conveying of the blanks from one station to another according to a trajectory which is substantially planar and horizontal is carried out using belt type conveyors which, by means of friction, grip the blanks between a lower conveyor and an upper conveyor. The lower conveyor is provided with lower belts and the upper conveyor is provided either with upper belts or with upper support rollers.

In order to comply with specific regulations in terms of information which is intended for visually impaired or blind persons, it has become necessary to print some messages in Braille characters on some packaging boxes, in particular on medication boxes. The Braille characters are embossed on a surface of the box in order to cause dots to appear in relief or protuberances which enable tactile reading of the messages.

The embossing of the Braille characters is carried out using a device which is mounted in an embossing module, installed in the folder-gluer. The device comprises two rotating embossing tools, a male embossing tool which cooperates with a female embossing tool, which tools are respectively mounted at respective opposite sides of the plane defined by the travel of the blanks in accordance with their trajectory.

The ease and rapidity with which a visually impaired or blind person reads the embossed message is dependent on the size, shape and regularity of the Braille characters which are located on the surface of the box. The Braille characters must be embossed without burrs and have a predetermined height. The quality of the box obtained in this manner is also dependent on the quality of the embossing of the Braille characters.

PRIOR ART

Document US 2012 053034 describes a module with a device for embossing Braille characters in a folder-gluer comprising two structures. An upper transverse structure carries cassettes which are provided with an upper embossing tool and a lower transverse structure carries cassettes which are provided with a lower embossing tool. The lower structure is maintained on the front and rear frame of the module. The upper structure pivots with respect to the lower structure owing to a transverse pivot axis which is located at the upstream side.

The height of the embossing can be adjusted. The distance between the two tools is first adjusted by two front and rear jacks. The jacks are fixedly joined to the lower structure and pull the upper structure, causing it to pivot in the direction of the lower structure.

A mechanism for fine adjustment of the height of the embossing are also provided. An upper stop which is fixedly joined to the upper structure moves against a lower stop which is fixedly joined to the lower structure. The lower stop is secured and the upper stop can be adjusted over a desired distance. The upper stop presses on the lower stop and pushes the upper structure away, causing it to pivot in the opposite direction to the lower structure.

However, such an adjustment is not precise. On the one hand, the jacks pull on a front and rear edge of the upper structure, which brings about deformations. On the other hand, the fine adjustment mechanism is mounted on the upper structure which can be pivotably moved. The fine adjustment system acts in compression, with the upper stop against the lower stop. All the forces are therefore absorbed by the upper structure, which brings about mechanical stresses in the transverse pivot axis. Owing to the slenderness extending through the upper structure, the stacking of the various fields of tolerance and the plays in the control mechanism of the fine adjustment, it is not possible to obtain the same adjustment between the front side and the rear side of the upper structure. Finally, the adjustment obtained is very variable over the entire length of the transverse upper structure between the front side and the rear side of the upper structure.

Document EP 1932657 has a device for embossing Braille characters in a folder-gluer. The device comprises two cylindrical rotating embossing tools. The blanks pass into the folder-gluer and are embossed by passing between the two tools. The device comprises an armature, a first structure which is mounted so as to be movable in translation relative to the armature and which is provided with the first cylindrical rotating tool, and a second structure, which is mounted so as to be fixed to the armature, and which is provided with the second cylindrical tool.

In order to adjust the height of the Braille characters, pushing means are provided and apply a pushing force to the mobile structure. Fine adjustment means are provided and comprise two beveled wedges which are arranged horizontally and which cooperate with each other via their respective inclined faces. A knurled wheel type screw drives one of the wedges in translation along the axis thereof. The inclined face of one of the wedges slides below the inclined face of the other of the wedges, bringing about the vertical displacement thereof.

However, owing to the longitudinal position of the wedges, the screw and the knurled wheel, it is difficult to improve the fine adjustment means. This is because the addition of components will laterally take up the space in which the cardboard blanks move. The addition of components no longer allows the passage of large blanks. The addition of components will limit the position of the Braille characters on the blank, with the characters no longer being able to be embossed in the center of the blank.

DESCRIPTION OF THE INVENTION

A main objective of the present invention involves implementing a method for adjusting a radial spacing between two rotating cylindrical embossing tools in an embossing device. A second objective is to produce an embossing device which has two rotating cylindrical tools and which is provided with means for adjusting the radial spacing between the two tools. A third objective is to adjust a radial spacing between two rotating cylindrical tools in order to adapt it in terms of the thickness of the support which has to be embossed. A fourth objective is that of providing means for adjusting in a precise manner the depth of embossing in the support. A fifth objective is to solve the technical problems mentioned for the document of the prior art. Another objective is that of producing a folder-gluer which is provided with an embossing module in which there is installed at least one embossing device which is more specifically intended for embossing Braille characters.

The invention relates to a method for adjusting a radial spacing between two rotating cylindrical embossing tools in an embossing device, of the type comprising an armature, a first structure, which is movably mounted in translation relative to the armature and which is provided with a first rotating cylindrical embossing tool, and a second structure which is mounted in a fixed manner on the armature and which is provided with a second rotating cylindrical embossing tool.

In accordance with a first aspect of the present invention, the method comprises the steps involving:

pushing on the first structure which is movably mounted in order to move it closer to the second structure which is mounted in a fixed manner, by leaning on the armature, in order to adjust a radial spacing between the first rotating cylindrical embossing tool and the second rotating cylindrical embossing tool, and pulling on the first structure which is movably mounted in order to move it away from the second structure which is fixedly mounted, by leaning on the armature, in order to finely adjust the radial spacing between the first rotating cylindrical embossing tool and the second rotating cylindrical embossing tool.

The first step involves placing the first tool in a state of pretensioning with respect to the second tool, by pushing the first structure, which can be moved and which carries the first tool, against the second structure, which is fixed and which carries the second tool. This first adjustment step allows the spacing to be adjusted, and more specifically the radial spacing, between the two tools, principally in accordance with the thickness of the support which must be embossed and which passes between the two tools.

The second step involves finely and precisely adjusting the position of the first tool relative to the second tool, by pulling the first structure, which can be moved and which carries the first tool, in order to move it away from the second structure, which is fixed and which carries the second tool. This traction is carried out counter to the pretensioning applied in the first step. This second adjustment step allows the spacing to be adjusted between the two tools principally in accordance with the depth of the desired embossing on the support.

In another aspect of the invention, an embossing device having two rotating cylindrical embossing tools comprises:

an armature, a first structure which is movably mounted in translation relative to the armature and which is provided with a first rotating cylindrical embossing tool, a second structure which is fixedly mounted on the armature and which is provided with a second rotating cylindrical embossing tool, a pushing member which is carried by the armature and which is capable of pushing the first structure which is movably mounted in the direction of the second structure which is fixedly mounted, in order to adjust a radial spacing between the first rotating cylindrical embossing tool and the second rotating cylindrical embossing tool, and means for adjusting the radial spacing between the first rotating cylindrical embossing tool and the second rotating cylindrical embossing tool.

The device is characterized in that the adjustment means comprise a pulling member which is carried by the armature and which is capable of applying a traction to the first structure which is movably mounted in order to move it away from the second fixedly mounted structure, in order to finely adjust the radial spacing between the first rotating cylindrical embossing tool and the second rotating cylindrical embossing tool.

According to yet another aspect of the invention, a folder-gluer is characterized in that it is provided with at least one device for embossing blanks, and which has one or more technical features which are described below.

BRIEF DESCRIPTION OF THE DRAWINGS

The invention will be clearly understood and its various advantages and different features will be better appreciated from the following description of the non-limiting embodiment, with reference to the appended schematic drawings, in which.

DETAILED DESCRIPTION OF PREFERRED EMBODIMENTS

Figure 1:
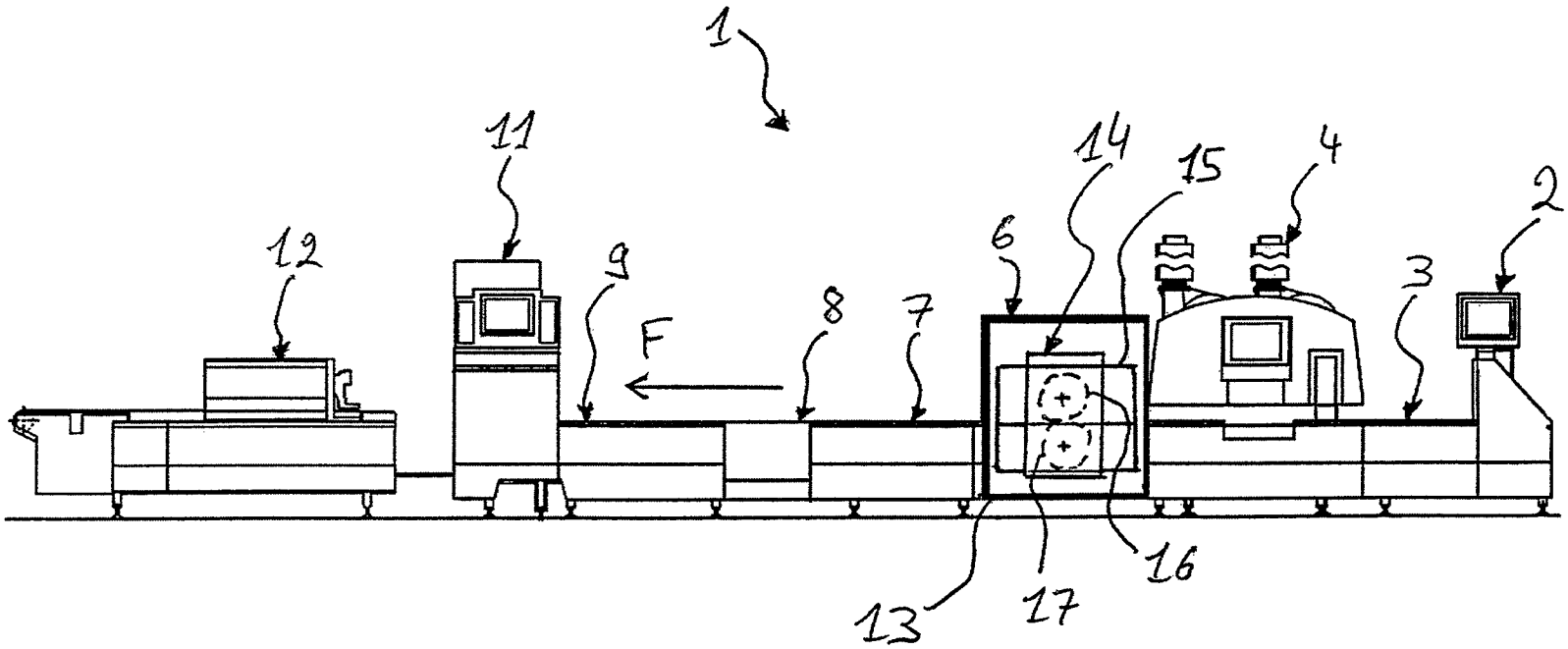
FIG. 1 is a synoptic side view of a folder-gluer which is provided with an embossing module and an embossing device.
Figure 2:
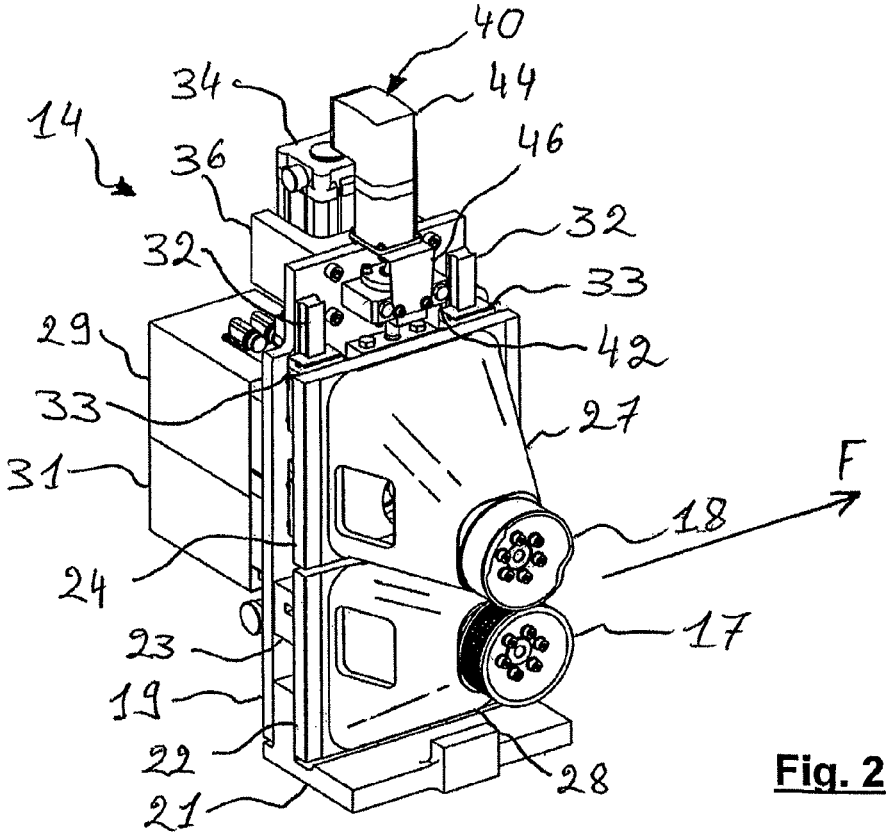
FIG. 2 is a rear perspective view of a device for embossing Braille characters according to the invention.

As illustrated in FIG. 1, a folder-gluer 1 is provided with a modular structure. The front is defined relative to the front face of the machine, at the side of the control platform of the machine, known as the "operator's side". The rear is defined relative to the rear face of the machine at the side opposite the control platform of the machine, known as the "opposite operator's side". The upstream and downstream positions are defined relative to the longitudinal direction and the movement direction of the blanks (arrow F in FIG. 1) from the input of the folder-gluer 1 to the output of the folder-gluer 1.

The folder-gluer 1 is provided successively in the downstream direction with a feeder 2, an alignment module 3, an on-line quality control device 4, a module for embossing Braille characters 6, a pre-breaking module 7, a gluing module 8, a folding module 9, a transfer module 11 and a delivery module 12.

The embossing module 6 comprises a frame 13 and a device 14 for embossing Braille characters (see document EP 1932657). The embossing module 6 may comprise two embossing devices, which are arranged at the front and rear side of the frame 13 of the module 6. The embossing module 6 also comprises two conveyors 15 for advancing cardboard in which the Braille characters are to be embossed, with only one of them illustrated in FIG. 1.

The embossing device 14 comprises in particular a first male upper rotating embossing tool 16 and a second female lower rotating embossing tool 17, the two tools 16 and 17 being rotatably mounted and cooperating with each other. The male tool 16 is comprised of a cylinder 18 whose peripheral surface is a metal plate which is provided with pins and which is wound on the cylinder 18. During the embossing operation, the pins are introduced into the thickness of the cardboard in order to form the Braille characters. The female tool 17 is comprised of a cylinder whose peripheral surface is provided with hollow members that receive the embossments in the underside of that cardboard that are produced by the pins. The blanks move between the two tools 16 and 17.

This embossing device 14 is maintained by the frame 13. When the embossing device 14 is located at the front side, the tools 16 and 17 are orientated in an overhanging manner toward the rear (set out in the description below). When the embossing device 14 is located at the rear side, the tools 16 and 17 are orientated in an overhanging manner toward the front.

The embossing device 14 comprises an armature with a substantially vertical plate 19 which is fixedly joined to a substantially horizontal base 21. The device 14 may be moved transversely, in order to be able to be moved away from or toward the conveyor or conveyors. The device 14 is mechanically connected to retention means and means for transverse translation (not illustrated), via the armature base 21. The retention means are of the rail type and are located on the frame 13. The translation means are of the transverse shaft and drive motor type and are located in the frame 13.

The embossing device 14 comprises a fixed lower structure in the form of a lower flank 22. The lower flank 22 is fixed to the rear of the armature plate 19 which is parallel therewith and perpendicular to the armature base 21, whilst being kept spaced apart by wedges 23.

The device 14 comprises a movable upper structure which comprises an upper flank 24 which is spaced above the lower flank. The upper flank 24 is retained at the rear of the armature plate 19 in a state parallel therewith, and in the extension of the lower flank 22.

The upper tool 16 is mounted at the rear free end of an upper tool-carrier shaft 26. The lower tool 17 is mounted at the rear free end of a lower tool-carrier shaft (which cannot be seen in the figures). The two lower and upper shafts 26 are parallel with each other and mounted in an overhanging manner.

The movable structure comprises an upper support housing 27 which retains and protects the upper shaft 26. The upper housing 27 is fixed to the rear of the upper flank 24. The fixed structure comprises a lower support housing 28 which retains and protects the lower shaft. The lower housing 28 is fixed to the rear of the lower flank 22. The two housings 27 and 28 are each generally in the form of a hollow truncated cone. In order to limit the flexion of the shafts, the two housings 27 and 28 each receive a bearing in order to retain the shafts as close as possible to the free ends thereof.

The upper shaft 26 is attached to the rotation axis of an upper synchronous drive motor 29, with the front side opposite the upper tool 16. The upper motor 29 is fixed to the front of the upper flank 24. In this embodiment, the upper tool 16, the upper shaft 26 and the upper motor 29 form part of the movable structure.

The lower shaft is attached to the rotation axis of a lower synchronous drive motor 31 opposite the lower tool 17. The lower motor 31 is fixed to the front of the lower flank 22. The lower tool 17, the lower shaft and the lower motor 31 form part of the fixed structure.

In order to begin an operation for embossing Braille characters, the tools 16 and 17 are correctly positioned relative to each other, on their respective shaft. To this end, axial wedging means are provided in order to axially move the lower tool 17 with the shaft and the motor 31 thereof. Angular wedging means are also provided and they correct any drift of the angular position of the tools 16 and 17 during production.

In order to ensure the adjustment of the spacing between the two tools 16 and 17, the movable structure 16, 24, 26, 27 and 29 moves vertically from the top to the bottom and vice versa. To this end, two vertical lateral sliding members 32 are provided at the rear of and at each side, upstream and downstream, of the armature plate 19. The upper flank 24 comprises two lateral sliding members 33 which are provided in order to maintain the upper flank 24, the upper tool 16, the upper shaft 26, the upper housing 27 and the upper motor 29; and the two lateral sliding members 33 are provided to slide on the two sliding members 32.

Figure 3:
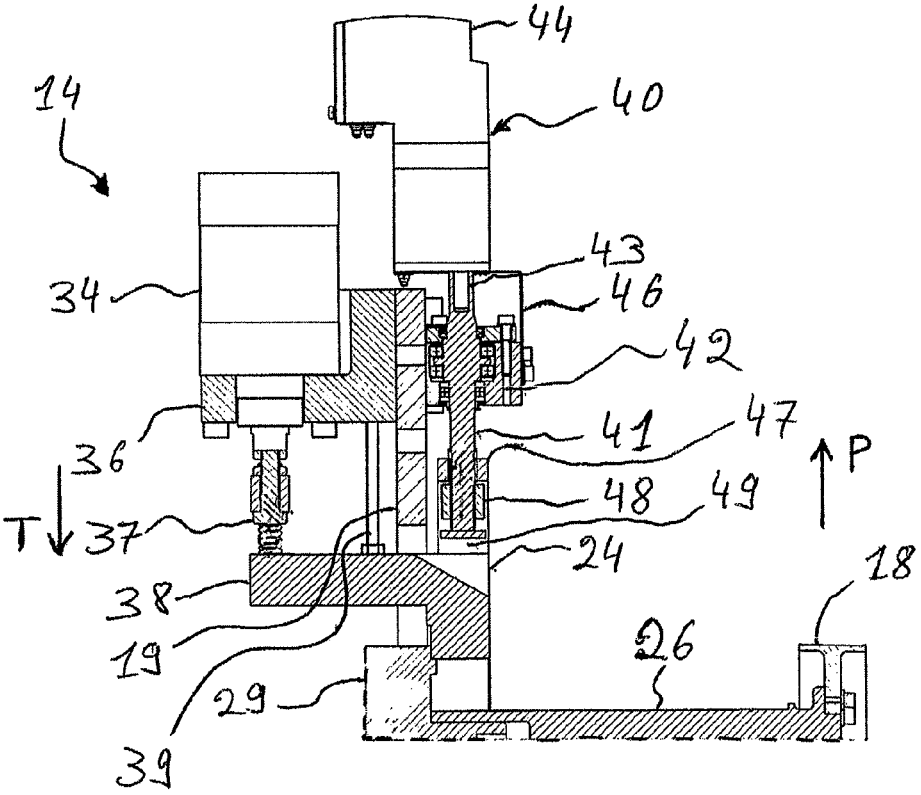
FIG. 3 is a partial cross section of the device of FIG. 2.

The embossing device 14 comprises a pushing member 34 which is carried by the armature 19 and 21 in order to carry out a first adjustment of the radial spacing between the upper tool 16 and the lower tool 17. The pushing member 34 is capable of pushing (arrow T in FIG. 3) the movable structure 16, 24, 26, 27 and 29 vertically in the direction of the fixed structure 17, 22, 28 and 31. The pushing force T is applied in a diametral direction which moves the upper tool 16 closer to the lower tool 17. The pushing member 34 is retained by a console 36 which is deployed at the front of the armature plate 19.

The pushing member 34 is, for example, in the form of a pneumatic jack. The base of the free end of the rod 37 of the jack 34 moves into abutment against an upper surface of a lug 38 of the upper flank 24 which is deployed toward the front. The movable structure with an upper flank 24, upper tool 16, upper shaft 26, upper housing 27 and upper motor 29 is pushed in a downward direction T in the direction of the fixed structure with the lower flank 22, lower tool 17, lower shaft, lower housing 28 and lower motor 31.

The embossing device 14 comprises a stop which can be adjusted. It is in the form of a bar 39 which is attached to the console 36 and the lug 38 of the upper flank 24. The stop 39 delimits a maximum travel path of the pushing member 34 and a minimum radial spacing between the two tools 16 and 17.

In accordance with the invention, the embossing device 14 comprises means for fine adjustment of the radial spacing which exists between the upper tool 16 and the lower tool 17. To this end, a pulling member 40 is provided. The pulling member 40 pulls (arrow P in FIG. 3) the movable structure 16, 24, 26, 27 and 29 vertically upward in order to move it away from the fixed structure 17, 22, 28 and 31. The pulling force P is applied in a diametral direction, which causes the upper tool 16 to move away from the lower tool 17.

In a very preferred manner, the pulling member 40 comprises a threaded rod 41. The rod 41 is fixed in translation, whilst being able to rotate, by the armature 19 and 21. More specifically, the rod 41 is fixed in translation, whilst being able to rotate, by a component which forms a bearing 42, which is fixedly joined to the rear of the armature plate 19. The component which forms a bearing 42 absorbs the traction forces applied to the rod 41.

The pulling member 40 comprises an electric drive motor 44. An upper end of the rod 41 is fixed to the rotation shaft 43 which is orientated vertically toward the base of the electric drive motor 44. The motor 44 drives the rod 41 in rotation, which causes it to rise or fall. The motor 44 is itself fixed to the rear of the armature plate 19 on the component which forms a bearing 42 via a fixing lug 46.

In order to bring about the traction P, the pulling member 40 advantageously comprises a first portion which forms a hook or which is hook-like, and which is provided in this instance at the end of the rod 41. This first portion which forms a hook moves into engagement with a second portion which forms a complementary hook which is present on the movable structure 16, 24, 26, 27 and 29.

Preferably, the second portion which forms a hook is a curved member 47 through which the rod 41 extends and which is fixedly joined to the first movable structure 16, 24, 26, 27 and 29. The curved member 47 is fixedly joined at an upper face of the upper flank 24, at the rear side with respect to the armature plate 19.

Advantageously, the first portion which forms a hook is a protuberance, for example, a nut 48, which is fitted and fixed to the end of the pulling member 40. The nut 48 is screwed to the end of the rod 41. The nut 48 is accommodated in a cavity 49 which is provided in the curved member 47. The first portion which forms a hook, that is to say, the nut 48, has a male convex shape which is accommodated in and which cooperates with the second portion which forms a hook, that is to say, the curved member 47, which has a complementary female concave shape. By adapting the nut 48 which moves into abutment against the walls of the cavity 49 of the curved member 47, the movable structure 16, 24, 26, 27 and 29 is self-centered with respect to the fixed structure 17, 22, 28 and 31.

The first portion which forms a hook, that is to say, the nut 48, advantageously has a position which can be adjusted by being screwed and unscrewed at the end of the pulling member, that is to say, the rod 41.

The assembly comprising the upper flank 24, upper tool 16, upper shaft 26, upper housing 27 and upper motor 29 is pulled upward P in the direction of the assembly comprising the lower flank 22, lower tool 17, lower shaft, lower housing 28 and lower motor 31.

The embossing device 14 can be used for embossing Braille characters on blanks of cardboard in the folder-gluer 1. A first task for the operator involves selecting the tools 16 and 17 in accordance with the message to be printed on the blanks which pass into the folder-gluer 1. Then, the tools 16 and 17 are mounted on their respective shaft and positioned angularly and axially.

The device 14 allows the implementation of a method for adjusting the radial spacing between the two rotating cylindrical embossing tools 16 and 17. The operator will thus first attend to the adjustment of the two tools 16 and 17 in accordance with the thickness of the cardboard blanks which pass into the folder-gluer 1. In this manner, in a first step, the first movable structure 16, 24, 26, 27 and 29 is pushed T by leaning on the armature 19 and 21, so as to be moved closer to the second fixed structure 17, 22, 28 and 31 so that the radial spacing between the first upper tool 16 and the second lower tool 17 is adjusted.

Then, the operator will adjust with precision the depth of penetration of the pins of the upper tool 16 in the cardboard blanks which are passing into the folder-gluer 1. In this manner, in a second step, the first movable structure 16, 24, 26, 27 and 29 is pulled P by leaning on the armature 19 and 21 in order to be moved away from the second fixed structure 17, 22, 28 and 31 so that the radial spacing between the first upper tool 16 and the second lower tool 17 is finely adjusted.

The present invention is not limited to the embodiments described and illustrated. Numerous modifications can be carried out, without for all that departing from the scope defined by the extent of the set of claims.

The electric drive motor 44 may be replaced by a small knurled wheel for fine adjustment.

The invention claimed is:

1. An embossing device having two rotating cylindrical tools, the embossing device comprising:

an armature;

a first structure movably mounted in translation relative to the armature, and the first structure is provided with a first rotating cylindrical tool;

a second structure fixedly mounted on the armature and the second structure is provided with a second rotating cylindrical tool;

a pushing member carried by the armature and configured for pushing the first structure in a pushing direction toward the second structure for moving the first tool closer to the second tool and for coarsely adjusting a radial spacing between the first and the second tools; and an adjusting device for adjusting the radial spacing between the first and second tools, the adjusting device comprising a pulling member carried by the armature and configured for applying a traction to the first structure for moving the first structure in a direction opposite to the pushing direction and away from the second structure for causing the first tool to move away from the second tool and finely adjusting the radial spacing between the first and the second tools.

2. A device according to claim 1, wherein the pulling member comprises a first portion, a second portion on the first structure, and the first portion is operable by the pulling member to move into engagement with the second portion.

3. A device according to claim 2, further comprising a cavity provided in the second portion, the first portion is accommodated in the cavity.

4. A device according to claim 2, wherein the first portion comprises a protuberance which is fixed to an end of the pulling member.

5. A device according to claim 2, wherein the first portion has a position at an end of the pulling member, the position being adjustable on the pulling member.

6. A device according to claim 2, wherein the second portion comprises a member through which the pulling member extends and which is fixedly joined to the first structure.

7. A device according to claim 1, wherein the pulling member comprises a threaded rod which is configured to be maintained in rotation by the armature, and by the first portion being maintained to an end of the threaded rod.

8. A device according to claim 7, further comprising a motor connected to drive the rod rotatably.

9. A device according to claim 1, further comprising an adjustable stop located and configured to delimit a maximum travel path of the pushing member and a minimum radial spacing between the tools.

10. A folder-gluer, comprising at least one device according to claim 1.

11. A folder-gluer according to claim 10, further comprising an embossing module and, the device comprising a device for embossing Braille characters and which is installed in the embossing module.

12. A device according to claim 1, wherein the first portion is a nut.

* * * * *